US006629326B2

(12) United States Patent
Rabe

(10) Patent No.: US 6,629,326 B2
(45) Date of Patent: Oct. 7, 2003

(54) SEE THROUGH SIDE SHIELD

(76) Inventor: Scott David Rabe, 6527 Smith Ave., Rome, NY (US) 13440

( * ) Notice: Subject to any disclaimer, the term of this patent is extended or adjusted under 35 U.S.C. 154(b) by 0 days.

(21) Appl. No.: 10/061,744

(22) Filed: Feb. 4, 2002

(65) Prior Publication Data

US 2003/0145385 A1 Aug. 7, 2003

(51) Int. Cl.[7] ..... A61G 7/05; A47C 21/08
(52) U.S. Cl. ..... 5/663; 5/424; 5/425
(58) Field of Search ..... 5/424, 425, 429, 5/430, 663

(56) References Cited

U.S. PATENT DOCUMENTS 3,344,445 A * 10/1967 Crawford ..... 5/430
4,370,765 A * 2/1983 Webber ..... 5/427
5,044,025 A * 9/1991 Hunsinger et al. ..... 5/424
5,421,046 A * 6/1995 Vande Streek ..... 5/624
5,450,641 A * 9/1995 Montgomery ..... 5/425
5,481,772 A * 1/1996 Glynn et al. ..... 5/663
5,749,112 A * 5/1998 Metzler ..... 5/424

* cited by examiner

*Primary Examiner*—Michael F. Trettel
(74) *Attorney, Agent, or Firm*—David Giglio, Esq.

(57) ABSTRACT

There is shown a see through side shield for use in a hospital bed which prevents a patient from becoming entrapped between a bed rail and a mattress. The see through side shield includes a hand that snugly fits over a lateral rail of the bed rail, typically the top lateral rail. The see through side shield further includes a partition that extends to cover a vertical opening between a top lateral side edge of the mattress and the bottom lateral rail of the bed rail. The partition is mounted to at least one lateral rail of the bed rail using a tightly fitting clamp. To permanently mount the partition, the clamp is riveted to the bed rail. Typically, the see through side shield is transparent being made of a polycarbonate material.

30 Claims, 9 Drawing Sheets

SEE THROUGH SIDE SHIELD

FIELD OF THE INVENTION

The present invention relates generally to hospital beds, and more particularly to an apparatus that prevents a patient from becoming entrapped between bed rails or between a mattress and bed rail of the hospital bed.

BACKGROUND OF THE INVENTION

In hospital beds, it is common to provide bed rails that are perpendicular and adjacent to a top lateral side edge of the mattress so that a patient does not roll over and slip out of bed. Known bed rails either pivot away from the mattress, move slidably downward, or are easily removed to allow ingress, egress and care for the patient. Referring to FIG. 1, typically, bed rails 10 comprise a foot rail 12 being telescoped inside of a head rail 14 allowing for adjustment of the length of the bed rail as needed.

Recently, concerns have been raised regarding the safety of these bed rails. It has been recorded that patients have become asphyxiated between a bottom lateral rail of the bed rail and the top lateral side edge of the mattress when the mattress is in the horizontal position. In other situations, as the head of the mattress rotates upward toward a forty five degree angle with respect to the horizontal, a substantially vertical triangular shaped opening is formed between the bottom lateral rail and the top side edge of the mattress. In these situations, patients often bury their faces against the mattress as their body slips through the opening. Trapped in this position, a patient has nothing to grasp to pull themselves upward as one arm is usually pinned under their body. This is especially problematic for bed-ridden patients who are too weak to pull themselves back through the opening.

It has also been reported that patients slide either on their abdomen or on their back through an opening between the mattress and the head or foot rail. The patient becomes lodged between the mattress and the head or foot rail and is often trapped in an inverted position with their head and neck jammed into a hyper-flexed or hyper-extended position near the floor.

To further complicate matters, there is no standardization as to key dimensions of hospital beds including bed rails and mattresses. For example, mattress thicknesses of the same make vary by as much as five centimeters and often become softer with age. Further, mattresses shrink during refurbishing. Approximately one-quarter of mattresses are replaced annually, whereas a hospital bed lasts for twenty years. Consequently, mattresses are often purchased from companies other than the hospital bed manufacturer. The non-specific relationship of mattresses, bed rails and bed frames results in variations in distances between mattresses and bed rails.

Studies have shown that gaps of six centimeters or less between bed rails and mattresses are required to prevent death or severe injury.

Some attempts at preventing patient entrapment include bolsters or long pillows that sit up on the mattress adjacent the bed rail. However, patients often become lodged between the bolster and the mattress. It is also common for these bolsters to be placed on the floor during care of the patient and thus, the mattress becomes contaminated and must be cleaned.

SUMMARY OF THE INVENTION

Therefore it is an object of the present invention to improve the health care field.

It is a further object of the present invention to improve the field of hospital beds.

It is another object of the present invention to provide a hospital bed that overcomes the limitations of the prior art.

It is still a further object of the present invention to provide a hospital bed that prevents a patient from entrapping themselves between the bed rail and mattress of the hospital bed.

It is yet a further object of the present invention to provide a transparent shield that prevents a patient from contacting lateral spaced rails of the bed rail.

It is still another object of the present invention to provide a bed rail system that prevents a patient from contacting lateral spaced rails of the bed rail.

It is yet another object of the present invention to provide a transparent shield that easily mounts to the bed rail.

It is yet still a further object of the present invention to provide a transparent shield that permanently mounts to the bed rail.

It is yet still another object of the present invention to provide a transparent shield that mounts to the bed rail, wherein the shield covers a substantial portion of the bed rail and the opening between the top edge of the mattress and the bed rail.

It is another object of the present invention to provide a transparent shield that mounts to the bed rail, wherein the shield covers a substantial portion of the bed rail and the opening between the top edge of the mattress and the bed rail in all positions as the head frame of the hospital bed is rotated toward a forty five degree angle with respect to the horizontal.

It is still yet a further object of the present invention to provide a universal transparent shield that efficiently cooperates with different sized bed rails, mattresses and hospital beds.

It is yet another object of the present invention to provide a transparent shield that is maintenance free, other than routine cleansing, once installed with the bed rail.

Another object of the present invention is to provide a transparent shield that does not impede the functions of the hospital bed, such as the raising or lowering of the bed or the bed rails.

These and other objects are obtained in accordance with the present invention wherein there is provided a shield for use with a hospital bed for preventing entrapment of a patient between a mattress and a bed rail of the hospital bed or between a pair of spaced rails of said bed rail. The bed rail includes a plurality of lateral rails interposed between a plurality of end rails. A top lateral side edge of the mattress and a bottom lateral rail of the bed rail forms a first vertical shaped opening. The shield includes at least one hand having an interior surface for contacting at least one lateral rail of said plurality of lateral rails. A vertically extending partition extends from said at least one hand. The partition is sized and shaped to substantially cover the first vertical opening. The partition is secured to the bed rail so that it cannot rotate away from, slide down, or fall away from the bed rail.

Typically, the hospital bed includes a head frame such that said head frame can be positioned between zero degrees in a non-rotated position and forty five degrees in a fully rotated position with respect to the horizontal. In the fully rotated position, the bottom lateral rail and the top lateral side edge of the mattress forms a second vertical shaped opening. The partition is sized and shaped to substantially cover said vertical shaped opening at all positions between the first and second vertical shaped openings.

The partition includes a top lateral edge and the hand laterally extends across the entire top lateral edge of the partition. In an alternative embodiment, a plurality of hands are interspaced across the top lateral edge of the partition. Typically, the hand is cylindrical shaped to substantially conform to the lateral rails. The partition is secured to at least one lateral rail using a clamp. For a permanent mount, the clamp is riveted to the partition. The partition is transparent and usually made from a polycarbonate material.

BRIEF DESCRIPTION OF THE DRAWINGS

The above and other objects of the present invention will be better understood by reading the following detailed description of the preferred embodiments of the invention, when considered in connection with the accompanying drawings, in which.

DETAILED DESCRIPTION OF THE INVENTION

Figure 2:
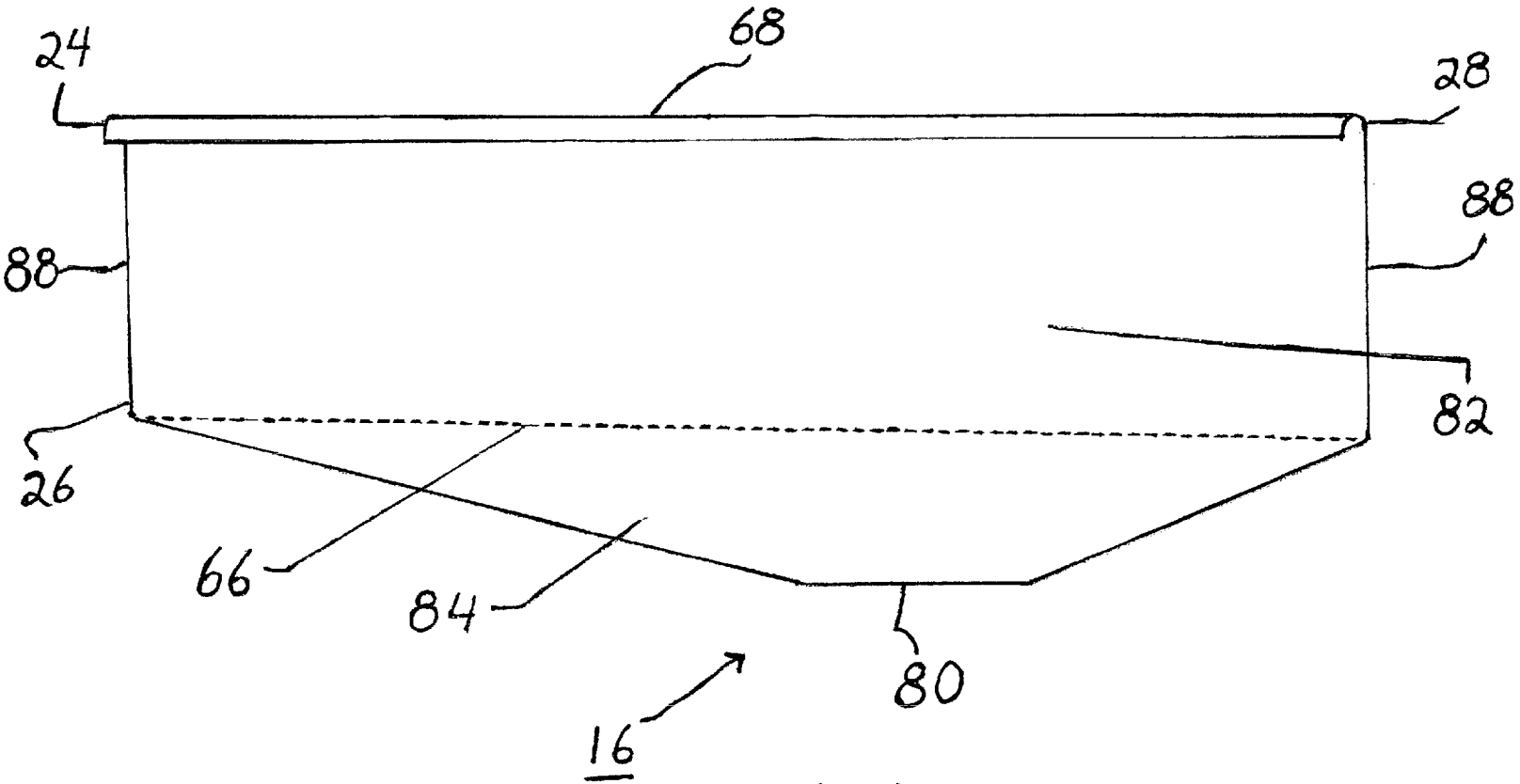
FIG. 2 is a perspective view of the see through side shield of the present invention.
Figure 3:
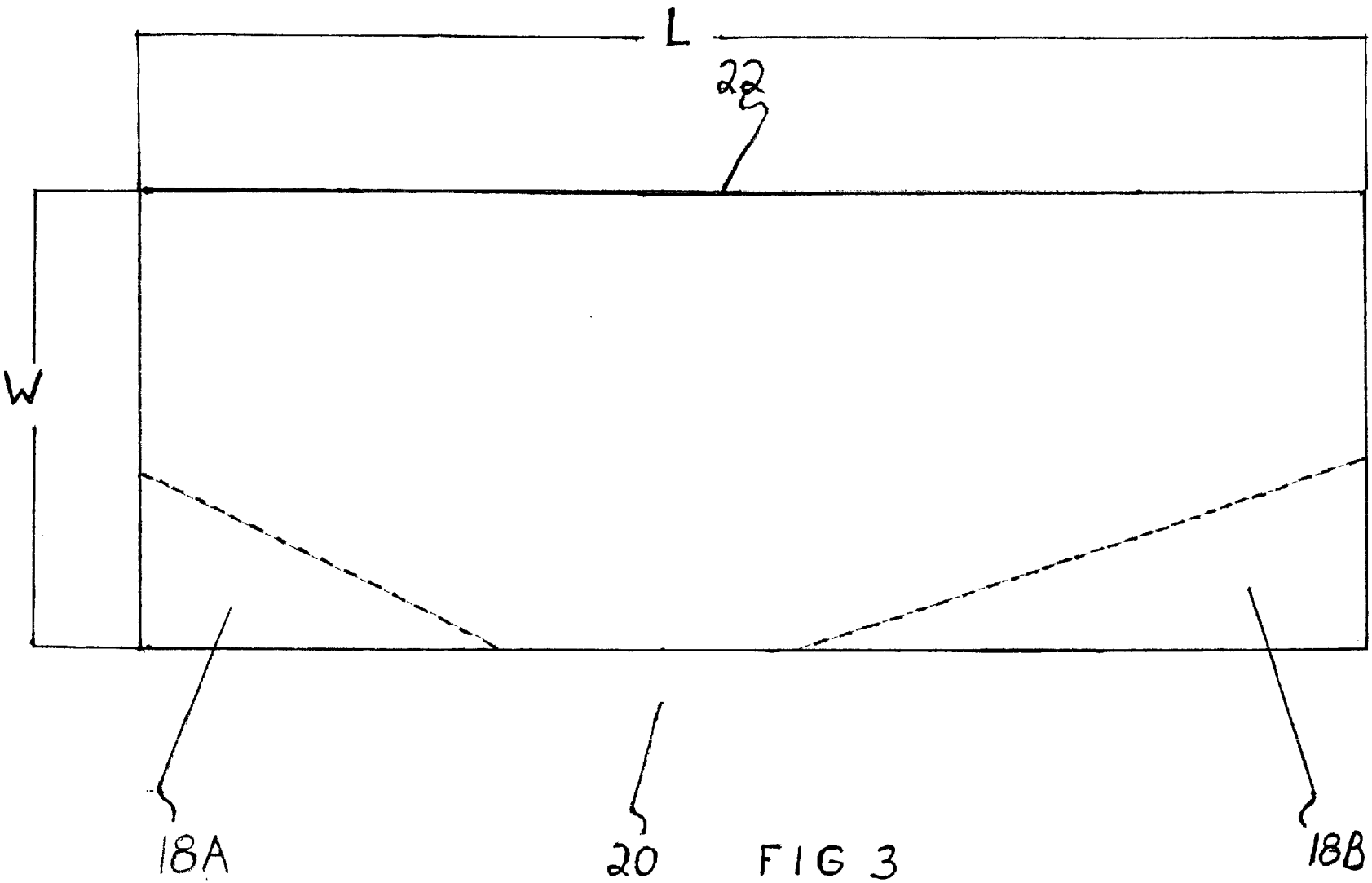
FIG. 3 is a side elevation view of the see through side shield of FIG. 2 as it is being manufactured.

Referring to FIG. 2, a see through side shield 16 according to the present invention is indicated generally. See through includes both transparent and semi-transparent. Shield 16 is a one piece design which is solid cast from a transparent material, typically a polycarbonate material. In a preferred method of making the shield shown in FIG. 3, two bottom corners 18A, 18B are cut from a rectangular piece 20 of 0.25 inch thick polycarbonate material having a length "L" of fifty-four inches and a width "W" of twenty-two inches. The edges of the cut rectangular piece are polished using a router so that they are smooth to the touch. Next, the rectangular piece is heated to approximately 300 degrees Fahrenheit. At this temperature, the top 22 of the rectangular piece 20 is rolled into an arcuate shaped hand 24 across its length.

Figure 5:
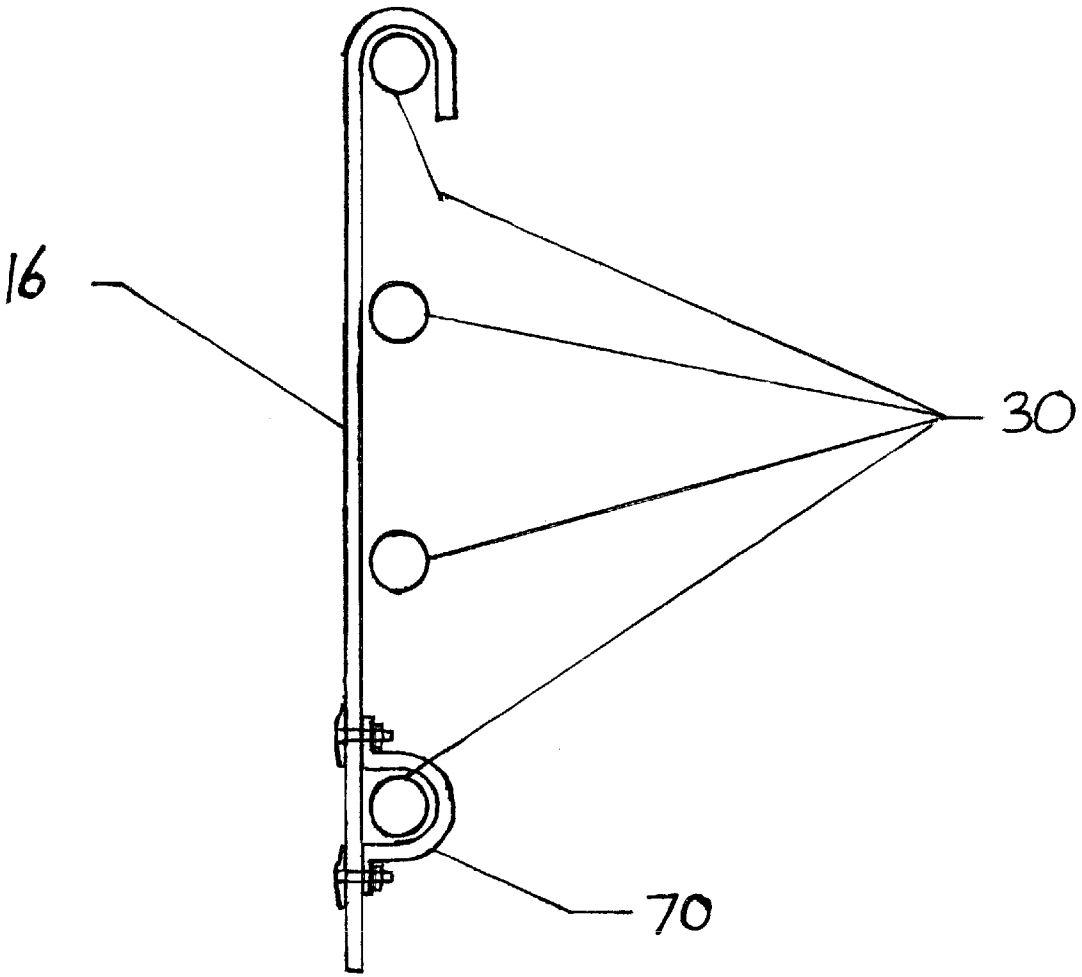
FIG. 5 is a side elevation view of the see through side shield in use with the bed rail of FIG. 3.
Figure 6:
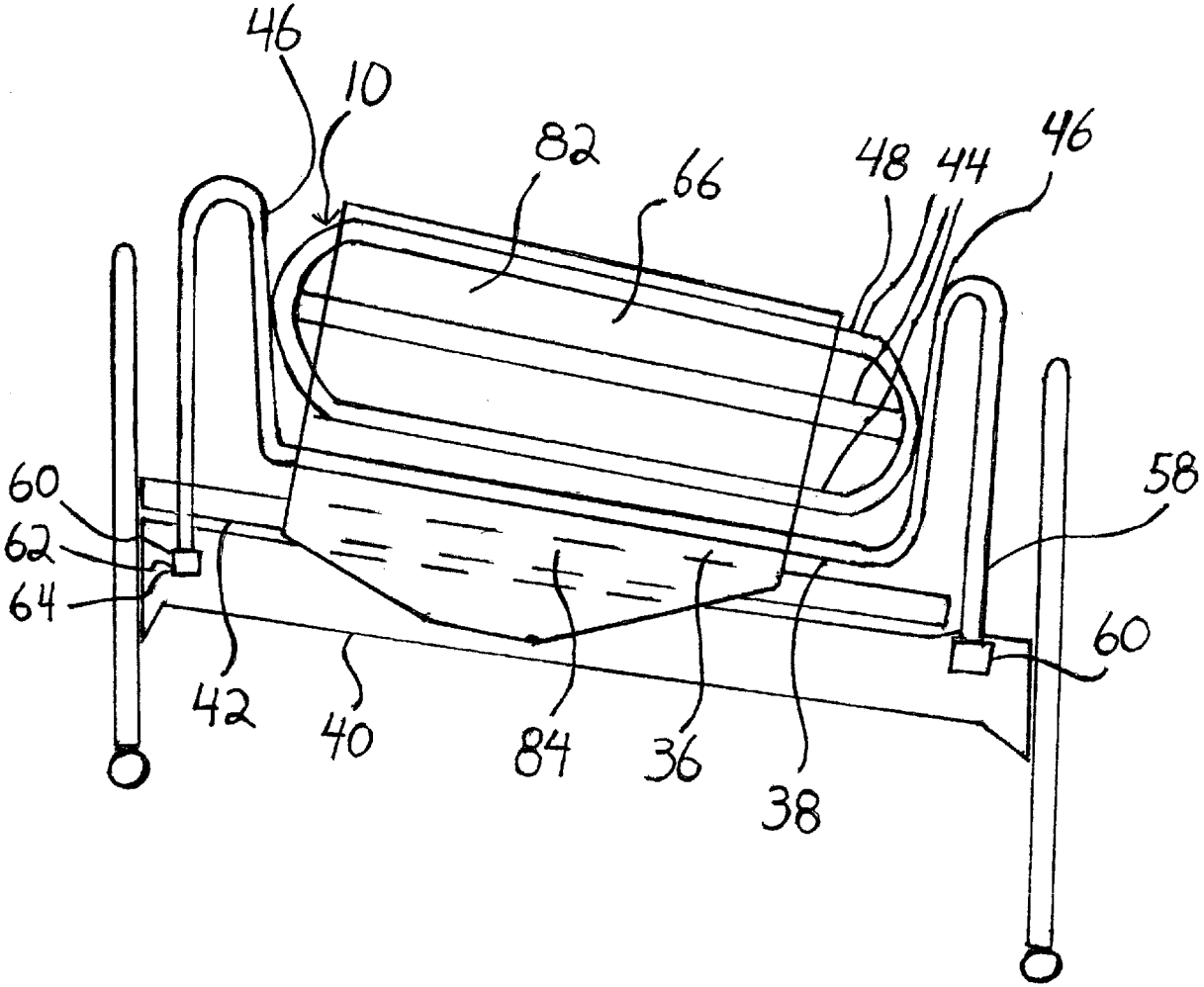
FIG. 6 is a side elevation view of the see through side shield and bed rail of FIG. 5 in use with a hospital bed.

The shield 16 now includes a hand 24 integrated with a downwardly extending partition 26. Hand 24 further includes an interior surface 28 which rests upon or grasps a lateral rail 30 of a bed rail 10 shown in FIGS. 4 and 5. Referring to FIG. 6, the partition 26 is sized and shaped to provide a barrier between a mattress 34 and the bed rail 10 which prevents a patient from coming into substantial contact with the bed rail 10 and from sliding between an opening 36 between the mattress 34 and a bottom lateral rail 38 of the bed rail 10. It should be apparent to one skilled in the art that other dimensions and shapes of polycarbonate material are also suitable for producing the shield 16. Furthermore, it should also be apparent that other suitable materials including acrylic material could also be used.

Figure 1:
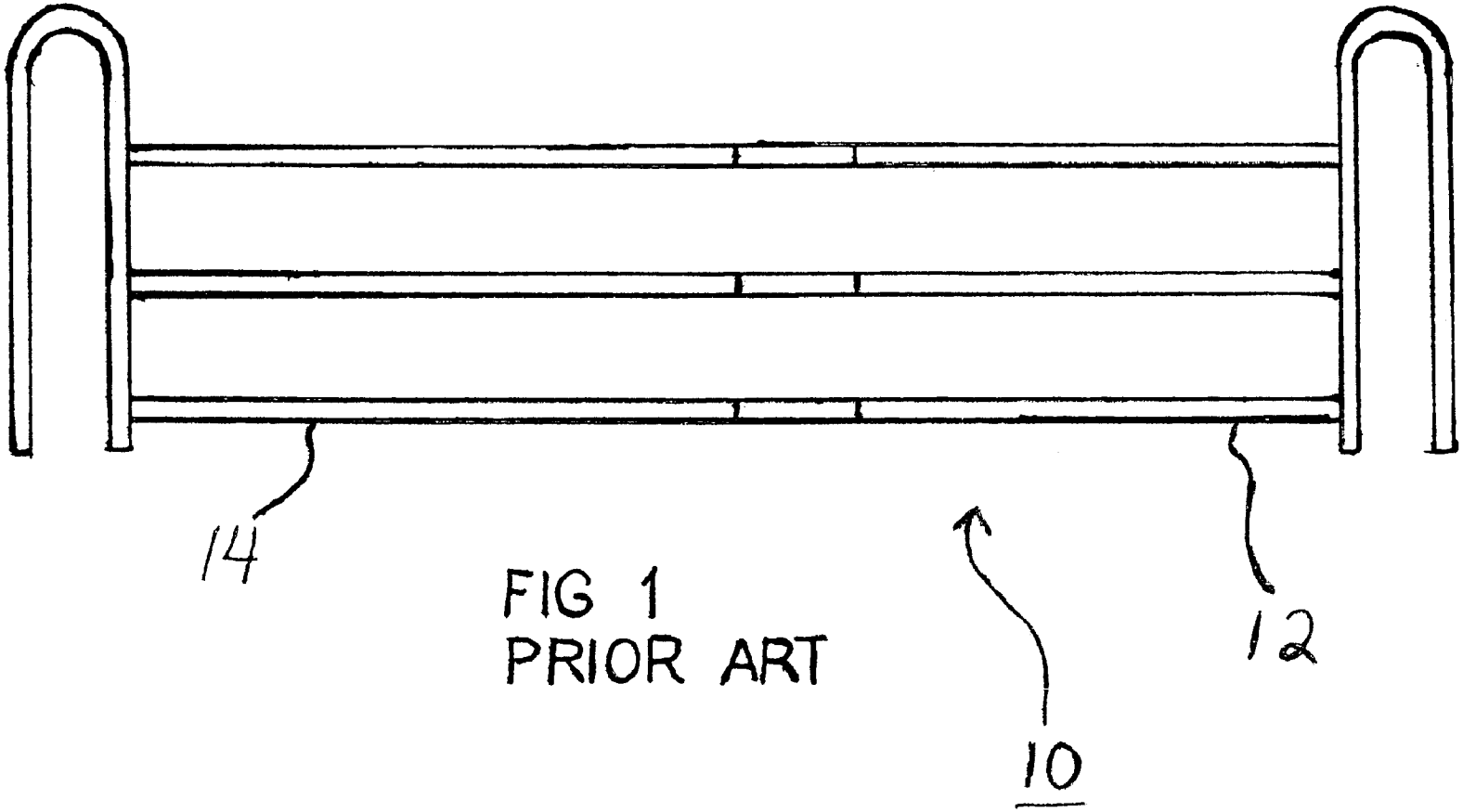
FIG 1 PRIOR ART
FIG. 1 is a side elevation view of a bed rail as known in the prior art.
Figure 7:
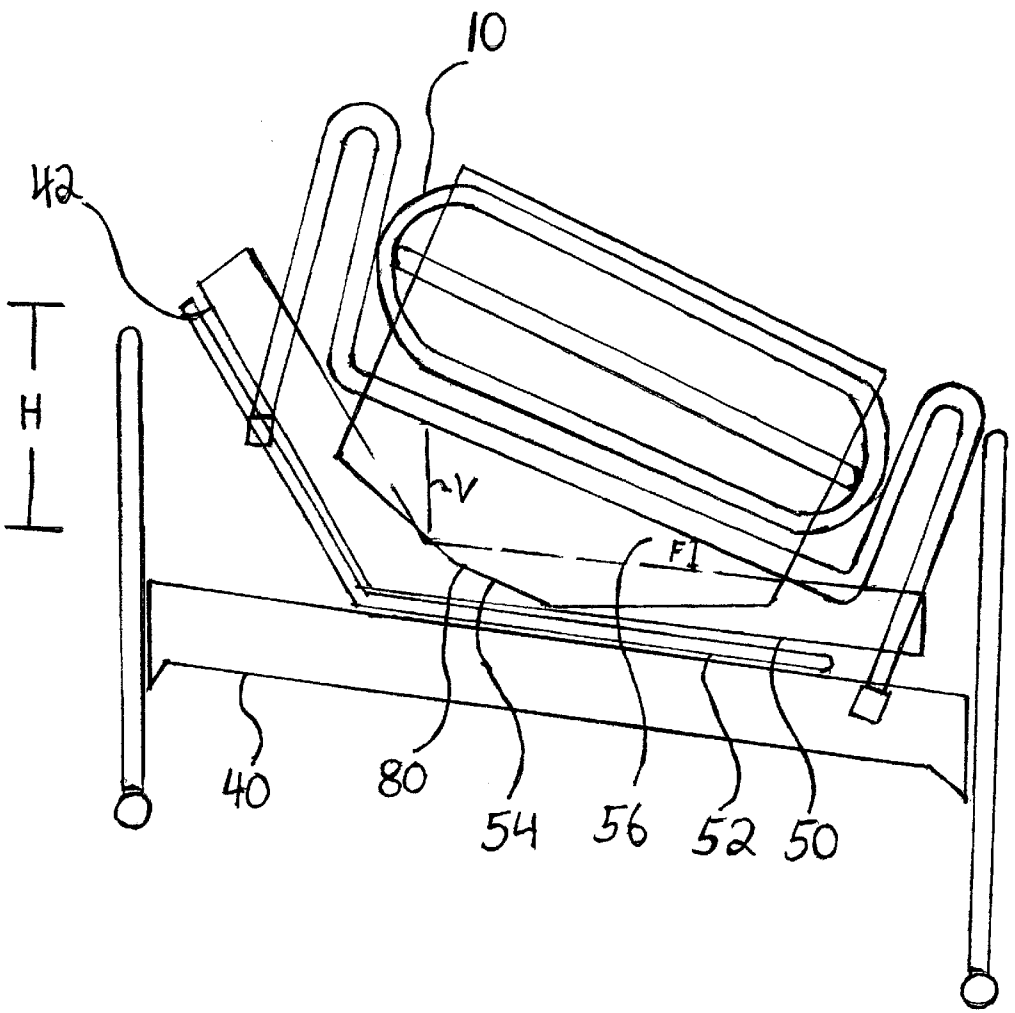
FIG. 7 is a side elevation view of the hospital bed of FIG. 5, wherein a head frame is rotated to a forty five degree angle.

Referring now to FIGS. 1, 6 and 7, there is shown a hospital bed 40 and bed rail 10 of the prior art. Hospital bed 40 includes a head frame 42 that rotates between the horizontal shown in FIG. 6 and forty five degrees shown in FIG. 7. Bed rail 10 includes a plurality of lateral rails 44 interposed between a pair of end rails 46. The lateral rails 44 include at least a top lateral rail 48 and the lateral bottom rail 38. A flexible mattress 50 sits on top of a frame 52 of the hospital bed 40. As the head frame 42 rotates, shown in FIG. 7, a top lateral edge 54 of the mattress 50 and the bottom lateral rail 38 forms a vertical triangular shaped opening 56.

In most cases, and as previously described, the foot rail 12 is telescoped inside of the head rail 14 so that the bed rail 10 expands/contracts when the head frame 42 is rotated.

It is known in the art that the bed rail 10 can be removed from the hospital bed 40 by many known means. For example, referring to FIG. 6, end rails 46 include downwardly disposed circular ends 58 which fit inside of rail guards 60. A pull pin 62 laterally disposed through a side of a rail guard 64 holds and releases the downwardly disposed circular ends 58. In this manner, the bed rail 10 is easily installed or removed from the hospital bed 40.

In another known embodiment, the bed rail 10 pivots about the rail guard 64 nearest the head frame 42 and swings away from the hospital bed 40, thus allowing for ingress, egress and care for a patient.

Figure 4:
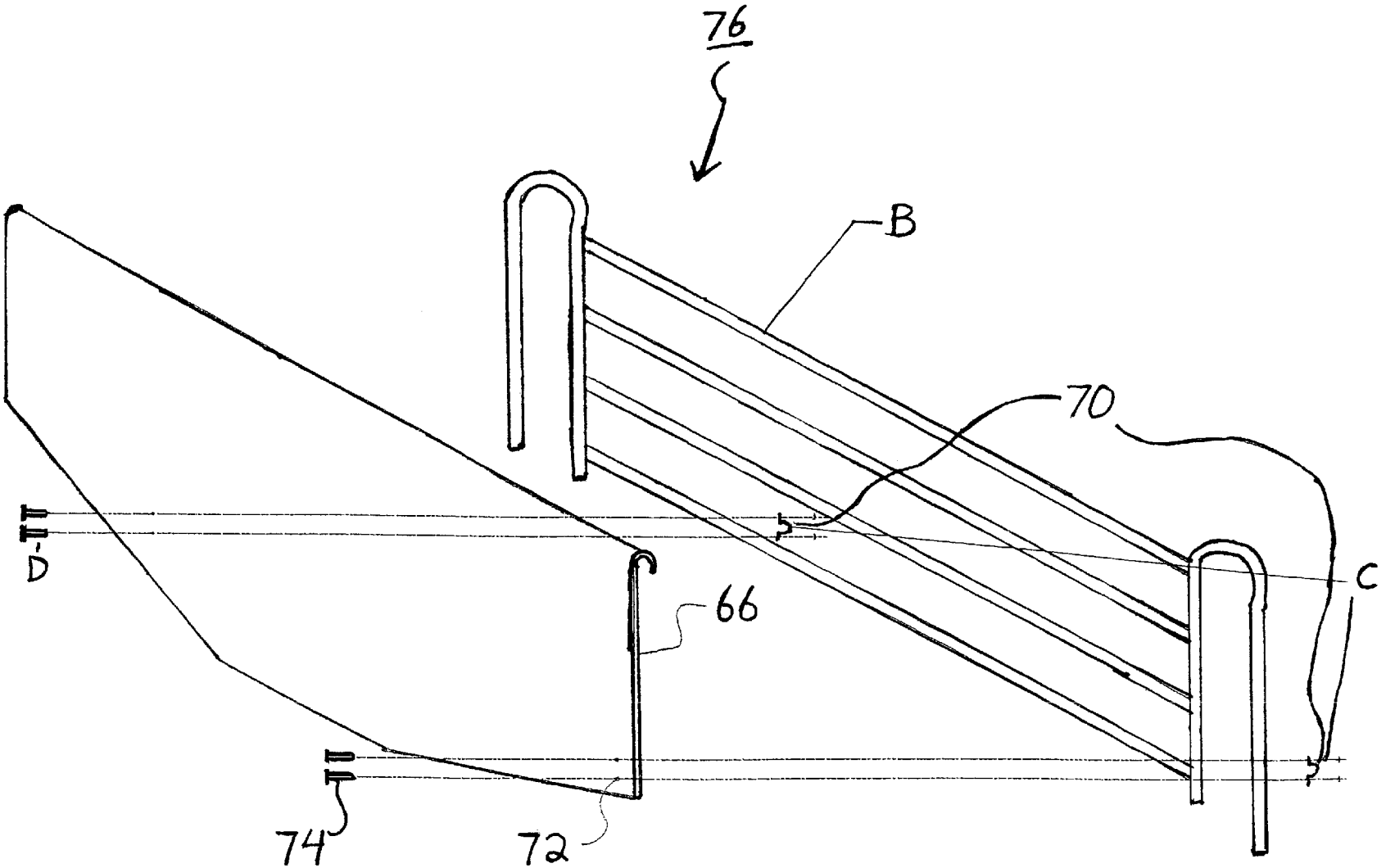
FIG. 4 is an exploded perspective view of the see through side shield of FIG. 2 in use with a bed rail.

The see through shield 16 of the present invention shall now be described in use with the hospital bed 40 and bed rail 10. First, with respect to the bed rail 10 and as shown in FIG. 4, the see through shield 16 permanently mounts to the bed rail 10. Although it is not necessary to permanently mount the shield 16 to the bed rail 10, the advantages of a permanent mount becomes apparent to one who works with the hospital bed 40. It is often necessary to clean and disinfect the shield 16 and bed rails 10, especially in a hospital setting. If the shield 16 were readily removable from the bed rail 10, there is no guarantee that it will be re-installed correctly or re-installed at all to the bed rail 10. Without the shield 16 being properly installed or not present at all, the patient becomes exposed to risks of serious harm.

The see through shield 16 includes a bed rail side 66 which faces the bed rail 10 when installed in the preferred embodiment, although it is also possible to reverse the orientation of the shield 16 with respect to the bed rail 10 without losing the shield's 16 effectiveness. The inside surface 28 of the hand 24 snugly fits over the top lateral rail 48 of bed rail 10, thereby preventing the shield 16 from sliding downward. The hand 24 also prevents the top of the shield 68 from rotating away from the bed rail 10.

A pair of U-clamps 70 installed about the lateral rails 44 of the head rail 14 and riveted to the partition 26 prevents the shield 16 from rotating in any direction away from the bed rail 10 and further secures the shield 16 to the bed rail 10. The U-clamps 70 are sized to fit the lateral rails 44, which are typically 0.75 inch or 1.0 inch outer diameter. A washer 72 having a 3/16 inch inside diameter and 3/16 inch rivets 74 are normally usually used to complete the installation. Having the U-clamps 70 riveted rather than nut and bolted results in a permanent installation. A bed rail system 76 is now provided wherein the shield 16 is permanently mounted to the head rail 14. As the head frame 42 rotates, the shield 16 moves as one with the head rail 14.

The advantages of the permanent mount includes the fact that the shield 16 cannot be removed from the head rail 14 and, therefore, cannot be improperly installed or not installed at all.

The size and shape of the see through shield 16 are very important to this invention. As previously described, the hospital bed 40 includes a head frame 42 that rotates between the horizontal shown in FIG. 6 and forty five degrees shown in FIG. 7. As previously described, the bed rail I 0 includes a plurality of lateral rails 44 interposed between a pair of end rails 46. As shown in FIG. 4 the lateral rails 44 include a top rail 48 and a bottom rail 38. A flexible mattress 50 sits on top of the frame 52 of the hospital bed 40. As the head frame 42 rotates, shown in FIG. 7, the top lateral edge 54 of the mattress 50 and the bottom lateral rail 38 forms the vertical triangular shaped opening 56. This vertical triangular shaped opening 56 includes a head height "H", a vertex height "V", and a foot height "F". Consequently, to prevent a patient from sliding between a bottom 80 of the shield 16 and the mattress 50, the shield 16 includes a size and shape which covers the vertical triangular shaped opening 56 when the mattress 50 is in the horizontal position, when the mattress 50 is in the forty five degree position and all angles in between.

As previously mentioned, mattresses 50, bed rails 10 and hospital beds 40 often vary in dimensions. The shield 16 includes a substantially rectangular upper portion 82 and a quadrilateral lower portion 84 to effectively cover the bed rail 10 and triangular shaped opening 56 of most mattresses 50, bed rails 10 and hospital beds 40 while still allowing for a efficient functioning of the hospital bed 40, such as removal/installation of the bed rail 10 or rotating the head frame 42 to a forty-five degree angle.

In use, the rectangular upper portion 82 covers the bed rail 10 and the opening between the top lateral side edge 54 of the mattress 50 when the head frame 42 is in the horizontal position. The quadrilateral lower portion 84 effectively covers the vertical triangular shaped opening 56 that is created as the head frame 42 is rotated toward the forty-five degree angle with respect to the horizontal.

Therefore, the shield 16 is of sufficient vertical length at both of its side edges 88 and bottom edge 80 to cover the distance between the bottom lateral rail 38 and the top side edge 54 of the mattress 50 when the head frame 42 is in the horizontal position. Further, the bottom edge of the shield 80 includes a shape that sufficiently covers the entire vertical triangular shaped opening 56 between the bottom lateral rail 38 and the top side edge 54 of the mattress 50 when the head frame 42 is rotated from the horizontal to the forty five degree position. It should be apparent to one skilled in the art that many sizes and shapes of the shield 16 will suffice to cover all vertical openings between the bottom lateral rail 38 and the mattress 50.

Turning now to the hand 24 of the shield 16, in a preferred embodiment, the hand 24 is sized and shaped to snugly fit over the top lateral rail 48 of the bed rail 10. The hand 24 typically runs the entire length of the partition 26, thereby allowing for easier manufacture. Lateral rails 44 are usually circular in shape so that the inside surface 28 of the hand 24 is cylindrical shaped allowing for a snug fit over the top lateral rail 48. The hand 24 provides support so that the shield 16 does not fall downward due to its own weight.

Figure 8:
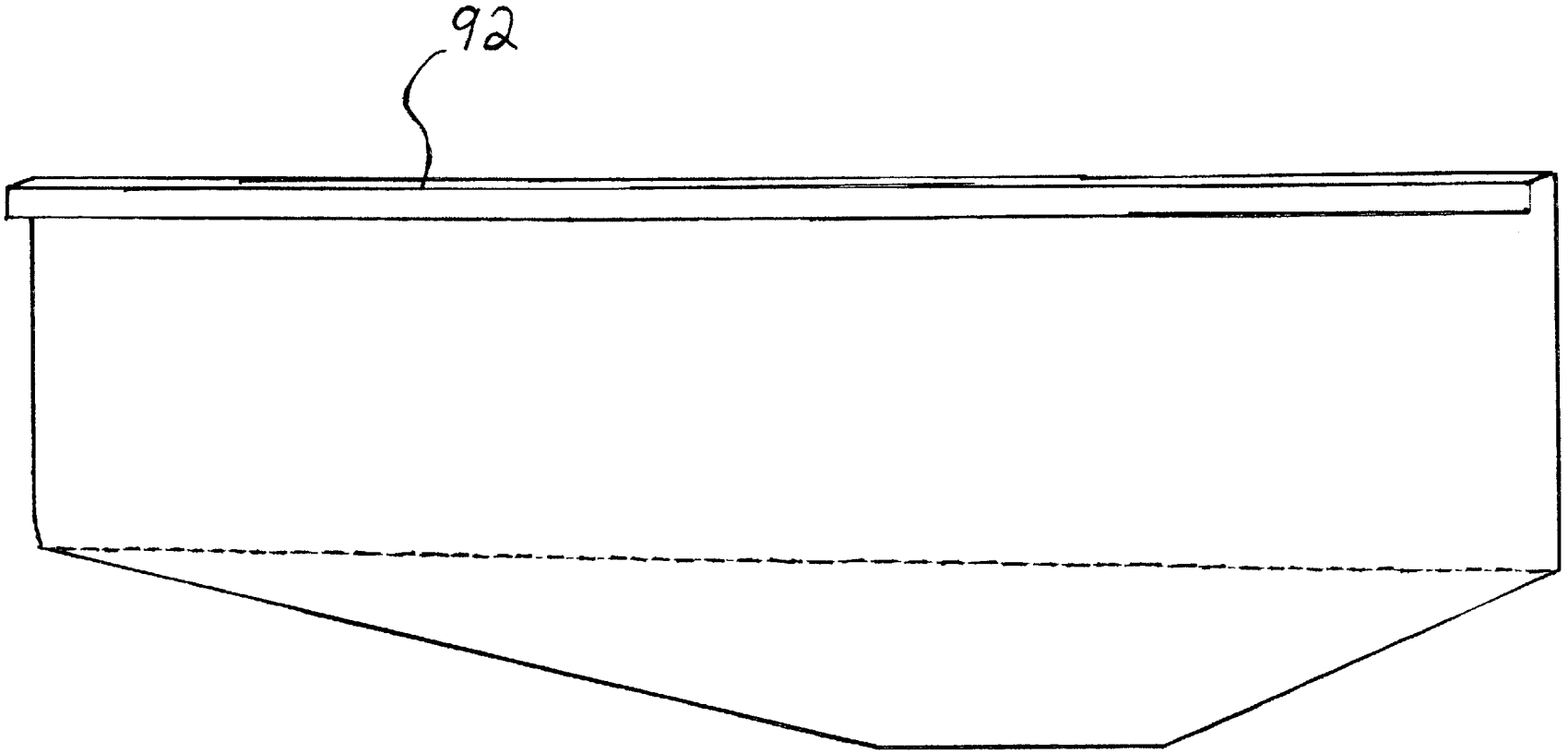
FIG. 8 is an alternative embodiment of the see through side shield of FIG. 2.
Figure 9:
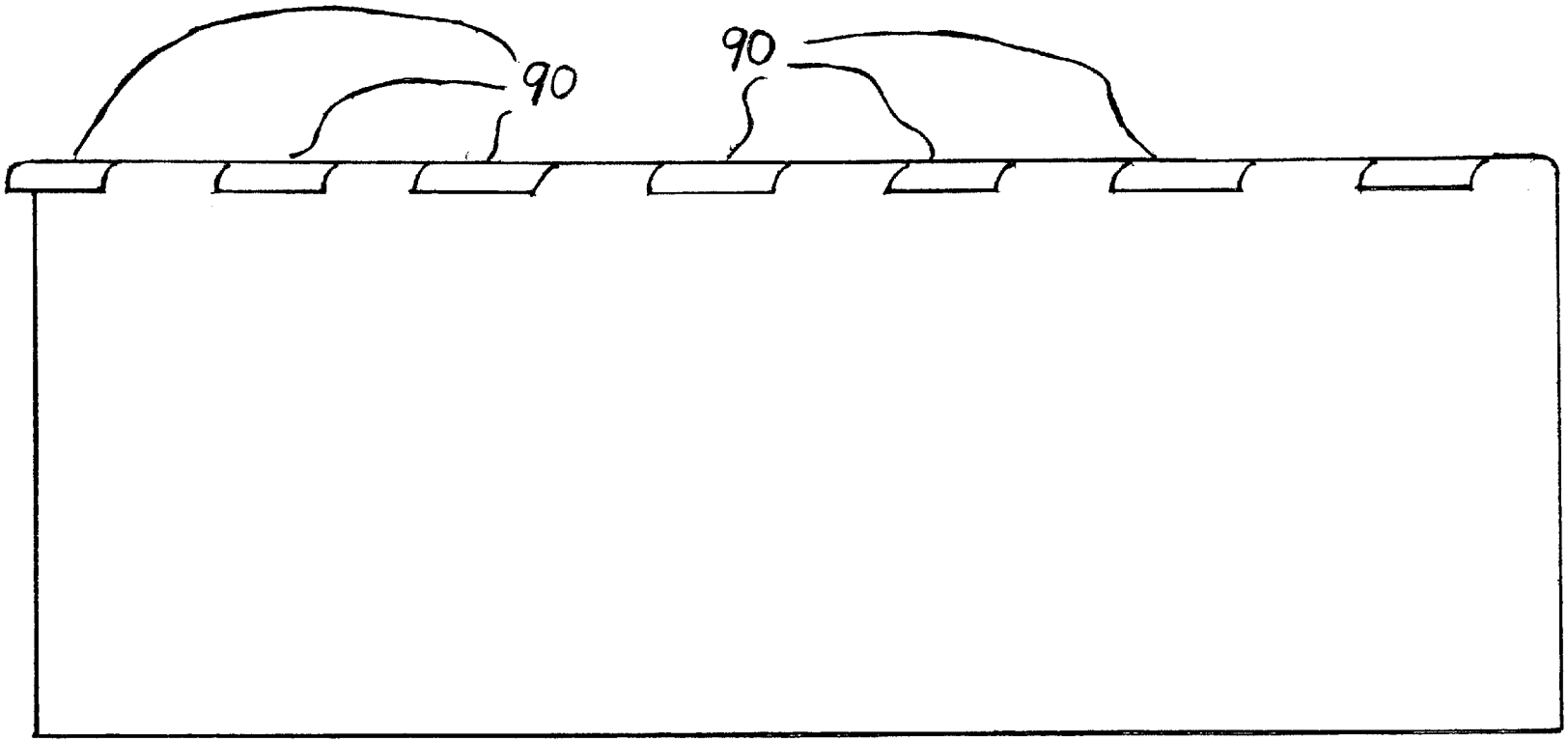
FIG. 9 is a second alternative embodiment of the see through side shield of FIG. 2.

In an alternative embodiment depicted in FIG. 8, a plurality of interspaced hands 90 provide for the same support as the one hand 24. Further, the hand or hands 92 can be trough shaped, shown in FIG. 9, which still provides the same function as the cylindrical shaped hand 24. Again, it should be apparent to one skilled in the art that many different hand designs function to prevent the shield 16 from sliding downward or from rotating away from the bed rail 10.

Various changes and modifications, other than those described above in the preferred embodiment of the invention described herein will be apparent to those skilled in the art. While the invention has been described with respect to certain preferred embodiments and exemplifications, it is not intended to limit the scope of the invention thereby, but solely by the claims appended hereto.

What is claimed is:

1. A shield for use with a hospital bed for preventing entrapment of a patient between a mattress and a bed rail of said hospital bed or between a pair of spaced rails of said bed rail, said bed rail including a plurality of lateral rails interposed between a plurality of end rails, wherein a top side edge of said mattress and a bottom lateral rail of said bed rail forms a first vertical shaped opening, said shield comprising:

at least one hand having an interior surface for contacting at least one lateral rail of said plurality of lateral rails;

a vertically extending partition which extends from said at least one hand, said partition being sized and shaped to substantially cover said first vertical shaped opening; and securing means for securing said shield solely to said bed rail.

2. The shield of claim 1, wherein said hospital bed includes a head frame such that said head frame can be positioned between zero degrees in a non-extended position and forty five degrees in a fully extended position with respect to the horizontal, and wherein said bottom lateral rail and said top lateral side edge of said mattress forms a second vertical shaped opening as said head frame is rotated from the horizontal toward its fully extended position and wherein said partition is sized and shaped to substantially cover said vertical shaped opening at all positions between the first and second vertical shaped openings.

3. The shield of claim 1, wherein said partition includes a top lateral edge and wherein said at least one hand laterally extends across the entire top lateral edge of said partition.

4. The shield of claim 1, wherein said partition includes a top lateral edge and wherein said at least one hand includes a plurality of hands interspaced across the top lateral edge of said partition.

5. The shield of claim 1, wherein the interior surface of said at least one hand is cylindrical shaped.

6. The shield of claim 1, wherein the interior surface of said at least one hand is trough shaped.

7. The shield of claim 1, wherein said securing means includes a clamp that is shaped to fit about a lateral rail of said bedrail.

8. The shield of claim 7, wherein said securing means further includes at least one rivet and washer to permanently mount said partition to said bedrail.

9. The shield of claim 1, wherein said partition is see-through.

10. The shield of claim 1, wherein said partition is made from a polycarbonate material.

11. A bedrail system for use with a hospital bed for preventing entrapment of a patient, said hospital bed including a mattress having a top lateral side edge, said bedrail system comprising:

a rail system having a plurality of lateral rails interposed between a plurality of end rails, said plurality of lateral rails including a bottom lateral rail such that said bottom lateral rail and said top lateral side edge of said mattress forms a first vertical shaped opening;

a shield having at least one hand having an interior surface for contacting at least one lateral rail of said plurality of lateral rails;

said shield further including a vertically extending partition which extends from said at least one hand, said partition being sized and shaped to substantially cover said first vertical shaped opening, said shield being secured solely to said rail system; and securing means for securing said shield to said rail system.

12. The bedrail system of claim 11, wherein said hospital bed includes a head frame such that said head frame can be positioned between zero degrees in a non-extended position and forty five degrees in a fully extended position with respect to the horizontal, wherein said bottom lateral rail and said top lateral side edge continues to form a shaped vertical opening as said head frame is rotated from the horizontal toward its fully extended position and wherein said partition is sized and shaped to substantially fill in said vertical opening at all positions between the first and second vertical shaped openings.

13. The bedrail system of claim 11, wherein said partition includes a top lateral edge and wherein said at least one hand laterally extends across the entire top lateral edge of said partition.

14. The bedrail system of claim 11, wherein said partition includes a top lateral edge and wherein said at least one hand includes a plurality of hands interspaced across the top lateral edge of said partition.

15. The bedrail system of claim 11, wherein the interior surface of said at least one hand is partially cylindrical shaped.

16. The bedrail system of claim 11, wherein the interior surface of said at least one hand is trough shaped.

17. The bedrail system of claim 11, wherein said securing means includes a clamp that is shaped to fit about a lateral rail of said bedrail.

18. The bedrail system of claim 17, wherein said securing means further includes at least one rivet and washer to permanently mount said partition to said bedrail.

19. The bedrail system of claim 11, wherein said partition is see-through.

20. The bedrail system of claim 11, wherein said partition is made from a polycarbonate material.

21. A hospital bed that prevents patient entrapment, said hospital bed comprising:

a mattress having a top lateral side edge;

a rail system having a plurality of lateral rails interposed between a plurality of end rails, wherein said top lateral side edge and a bottom lateral rail of said plurality of lateral rails forms a first vertical shaped opening;

a shield having at least one hand having an interior surface for contacting at least one lateral rail of said plurality of lateral rails;

said shield further including a vertically extending partition which extends from said at least one hand, said partition being sized and shaped to substantially said first vertical shaped opening, said shield being solely secured to said rail system; and securing means for securing said shield to said rail system.

22. The hospital bed of claim 21, wherein said hospital bed further includes a head frame such that said head frame can be positioned between zero degrees in a non-extended position and forty five degrees in a fully extended position with respect to the horizontal, and wherein said bottom lateral rail and said top lateral side edge of said mattress forms a second vertical shaped opening as said head frame is rotated from the horizontal toward its fully extended position and wherein said partition is sized and shaped to substantially fill in said vertical shaped opening at all positions between the first and second vertical shaped opening.

23. The hospital bed of claim 21, wherein said partition includes a top lateral edge and wherein said at least one hand laterally extends across the entire top lateral edge of said partition.

24. The hospital bed of claim 21, wherein said partition includes a top lateral edge and wherein said at least one hand includes a plurality of hands interspaced across the top lateral edge of said partition.

25. The hospital bed of claim 21, wherein the interior surface of said at least one hand is partially cylindrical shaped.

26. The hospital bed of claim 21, wherein the interior surface of said at least one hand is trough shaped.

27. The hospital bed of claim 21, wherein said securing means includes a clamp that is shaped to fit about a lateral rail of said bedrail.

28. The hospital bed of claim 27, wherein said securing means further includes at least one rivet and washer to permanently mount said partition to said bedrail.

29. The hospital bed of claim 21, wherein said partition is see-through.

30. The hospital bed of claim 21, wherein said partition is made from a polycarbonate material.

* * * * *